United States Patent [19]

Hoffman

[11] 4,067,634

[45] * Jan. 10, 1978

[54] DEAD-FRONT ELECTRICAL HOUSING

[75] Inventor: Ernest Gerhard Hoffman, Middlefield, Conn.

[73] Assignee: Harvey Hubbell, Incorporated, Orange, Conn.

[ * ] Notice: The portion of the term of this patent subsequent to Mar. 8, 1994, has been disclaimed.

[21] Appl. No.: 772,672

[22] Filed: Feb. 28, 1977

Related U.S. Application Data

[63] Continuation of Ser. No. 609,797, Sept. 2, 1975, Pat. No. 4,010,999.

[51] Int. Cl.[2] ..... H01R 13/58

[52] U.S. Cl. ..... 339/107; D13/30; 339/128; 339/210 M

[58] Field of Search ..... 339/107, 105, 191 R, 339/59 M, 75 MP, 91 R, 128, 131, 176 MP, 210 M; D13/27, 30

[56] References Cited

U.S. PATENT DOCUMENTS 3,784,961 1/1974 Gartland, Jr. ..... 339/107

FOREIGN PATENT DOCUMENTS 1,394,871 3/1965 France ..... 339/107

676,144 7/1952 United Kingdom ..... 339/107

*Primary Examiner*—Roy Lake
*Assistant Examiner*—DeWalden W. Jones
*Attorney, Agent, or Firm*—Jerry M. Presson

[57] ABSTRACT

A one-piece housing for electrical terminals is disclosed, the housing being of the dead-front type and the enclosed terminals being connectable to external electrical circuits through apertures in the dead-front. The housing is generally formed of a dead-front or base member and two side casings, with web hinges joining these members as integral parts and allowing the side casings to pivot into opened and closed positions on the base member. Screw fasteners, located adjacent the ends of the casings remote from the web hinges, secure the casings together and clamp an electrical cord that is wired to the electrical terminals. Access to the enclosed electrical terminals is obtained, for wiring purposes, by opening one or both of the side casings. Locking lugs are formed integral with the side casings and base member to secure the casings to said base member, when the casings are closed, and provide a locking action in directions both longitudinal and lateral of the housing. These locking lugs thus remove both longitudinal and lateral stresses from the web hinges, and even permit continued use of the housing if the web hinges should fracture after repeated flexing.

14 Claims, 10 Drawing Figures

DEAD-FRONT ELECTRICAL HOUSING

CROSS-REFERENCE

This application is a continuation of applicant's copending application Ser. No. 609,797, filed Sept. 2, 1975, U.S. Pat. No. 4,010,999 entitled "Dead-Front Electrical Plug".

BACKGROUND OF THE INVENTION

This invention relates to a one-piece dead-front electrical housing of high strength which is inexpensive to manufacture and extremely safe and convenient to use.

Most common electrical housings are of the so-called live-front type, where access to the terminals within the housing is obtained through the face or front of the housing. These housings generally use a removable insulating disc as the face or front member, the disc being removable to secure access to the internal terminals. A high level of care is required in both the wiring and subsequent use of these housings, to provide safe and trouble-free service.

Electrical housings of the dead-front type are known. In these housings, the face or front member is not removable, but simply contains apertures through which electrical contact can be made to the enclosed terminals. Access to the terminals for wiring purposes is provided from behind the face or front and, when the wiring is completed, the terminals are generally enclosed by a casing or cover. Electrical housings of the dead-front type are generally safer both during the wiring operation and subsequent use. However, they generally comprise more parts, are more costly to produce, and less convenient to use than live-front housings, and consequently they have not come into widespread use and acceptance.

SUMMARY OF THE INVENTION

The invention involves a one-piece dead-front electrical housing formed of a dead-front or base member and side casings hingedly connected thereto by webs. Electrical terminals are enclosed within the housing and are connectable electrically to external electrical circuits through apertures in the dead-front, through which contact blades can extend. One end of each side casing is attached to the base by a web hinge, to permit the side casings to open when access to the enclosed terminals is desired, and close for completely encasing the terminals.

Screw fasteners are located at the ends of the casings remote from the web hinges, to secure the casings together and clamp the electrical cord, and locking lugs are advantageously formed integral with the casings and base member, in order to lock the casings to said base member when the casings are closed, in directions both longitudinal and lateral of the housing. These locking lugs thus remove both longitudinal and lateral stresses from the web hinges, and even permit continued use of the housing if the web hinges should fracture after repeated flexing. One of these locking lugs for each side casing is advantageously located on the casing near the associated web hinge, such that when the casing is closed a locking engagement occurs near the plane of the web hinges, but inwardly of the hinges, to provide an effective lock laterally disposed inwardly from each hinge. This lateral locking engagement, together with other locking engagement which is effective longitudinally, holds the casings in place, and thus permits continued use of the housing even if one or more of the hinges should fracture.

Also, there are locking lugs on the casings which engage one another when the casings are closed, to prevent the casings from being misaligned when they clamp about the electrical cord.

OBJECTS OF THE INVENTION

It is a principal object of this invention to provide a high strength, one-piece dead-front electrical housing which is inexpensive to manufacture, both safe and convenient to wire, and safe in subsequent use.

It is a further object of the invention to provide such a one-piece dead-front electrical housing which utilizes web hinges but which continues to be usable even if one or more of the web hinges should fracture.

It is a further object of the invention to provide a fully moisture-proof dead-front electrical housing with efficient strain-relieving cord retention.

These and other features and objects of the invention become apparent from the following detailed description of the preferred embodiments of the invention.

DRAWINGS

The same reference numerals refer to the same elements throughout the various Figures.

DESCRIPTION OF PREFERRED EMBODIMENTS

Figure 1:
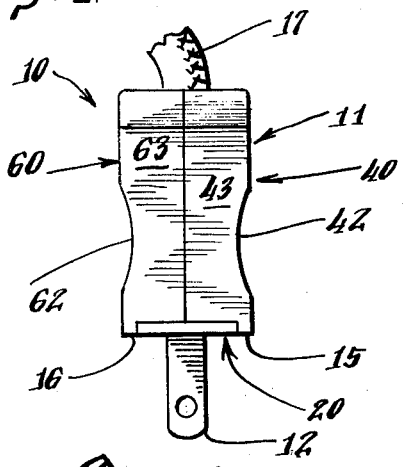
FIG. 1 is an end-side view of an electrical plug connector according to the invention herein.

In Figures 1 - 6 there is shown a one-piece dead-front electrical plug 10 of high strength, according to the invention herein. The dead-front electrical plug 10 comprises generally a plug body 11 and two power blades 12 and 13, and is adapted to make electrical connection between a cord 17 and a standard electrical socket outlet, not shown. The plug body 11 is generally comprised of a dead-front member 20 through which power blades 12 and 13 are mounted, and two side covers 40 and 60. The side covers 40 and 60 are hingedly connected to the dead-front member 20 by web hinges 15 and 16, and the entire plug body 11 is formed integrally of a high strength insulating material, such as nylon.

Referring now to FIGS. 3 - 6 in which the details of the structure of the dead-front electrical plug 10 are shown, the dead-front member 20 is comprised of a rectangular bottom plate 21 which forms a smooth base or front of the plug except for two elongated notch openings 22 and 23 located midway along the side edges of the bottom plate 21 adjacent to side covers 40 and 60, respectively. An upstanding flange 24 is provided about the rectangular periphery of the bottom plate 21. Two additional upstanding flanges 25 and 26 together with the peripheral flange 24 define two elongated grooves 27 and 28 which are parallel to the end edges of the bottom plate 21.

A block 30 is integrally formed with and upstands from the central inner area of the bottom plate 21, and a rectangular groove 31 is defined surrounding the sides of the block 30 between it and the flanges 24 - 26. The block 30 serves as a mounting and support member for the power blades 12 and 13, which are press fit into openings extending through the block 30 and the bottom plate 21 integral therewith. The upper terminal ends of the power blades 12 and 13 are provided with terminal screws 18 and 19 which are readily accessible when the dead-front electrical plug is in the open condition shown in FIGS. 5 and 6 for facilitating wire connections with wire conductors 32 and 33 of cord 17. An "H" shaped insulation barrier 34 is formed integrally with and upstanding from the block 30, and is positioned between the upper terminal ends of power blades 12 and 13.

Figure 4:
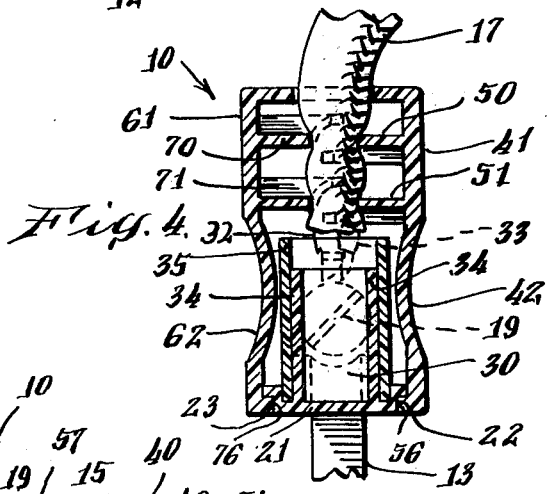
FIG. 4 is a sectional view of the electrical plug connector of FIG. 1 taken along the lines 4—4 of FIG. 2.
Figure 5:
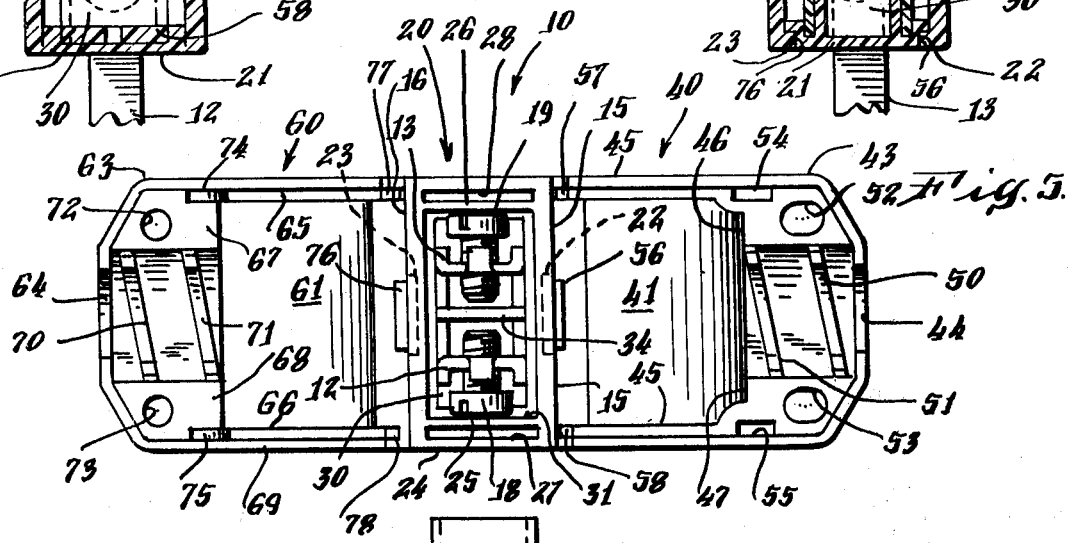
FIG. 5 is a top view of the electrical plug connector of FIG. 1 in its open condition.

Referring particularly to FIGS. 4 and 5, it will be noted that the rectangular groove 31 defined between the block 30 and the flanges 24 - 26 is adapted to receive the lower end of an optional rectangular sealing compound barrier sleeve 35. The sealing compound barrier sleeve 35 surrounds the upper ends of the power blades 12 and 13, their associated terminal screws 18 and 19, and any uninsulated or stripped portion of the wire conductors 32 and 33 adjacent to their connection to the terminal screws. The sealing compound barrier sleeve 35 is filled with a sealing or potting compound (not shown) which cures to provide a protective, fully moisture-proof wiring connection between the wire conductors and the power blades. Of course, the sealing compound barrier sleeve 35 and sealing compound may be omitted and are not necessary to the structure of the dead-front electrical plug 10, although they do provide additional safety and service features and are accordingly preferred.

Figure 6:
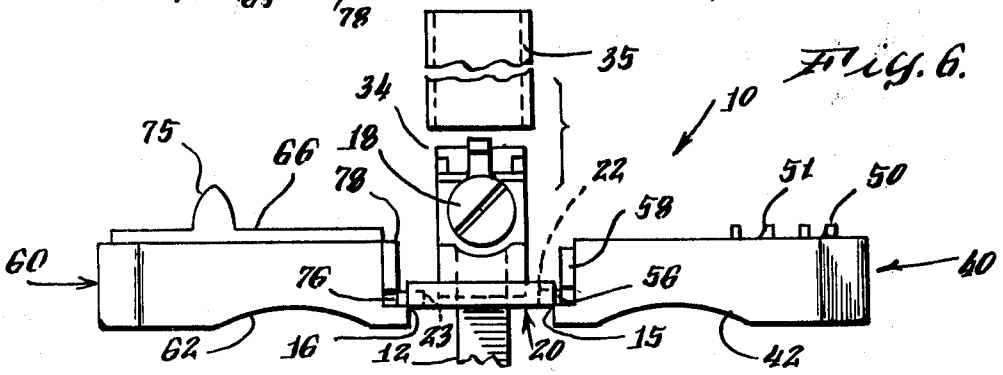
FIG. 6 is an end view of the electrical plug connector of FIG. 1 in its open condition.
Figure 7:
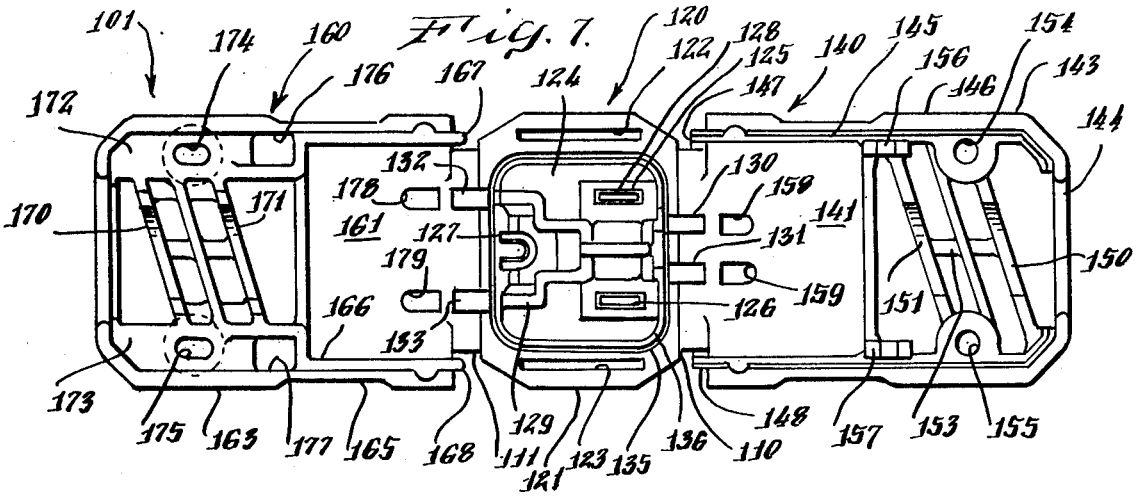
FIG. 7 is a top view of another electrical plug connector according to the invention herein in its open condition.

The plug body 11 of the dead-front electrical plug 10 further comprises side covers 40 and 60 which are integrally connected to the dead-front member 20 by means of web hinges 15 and 16, respectively. As best seen in FIGS. 5 and 6, web hinges 15 and 16 each comprise two thin, aligned, flexible webs which flank the notches 22 and 23 in the bottom plate 21 of the dead-front member 20 and extend between the bottom plate 21 and the side covers 40 and 60, wherein the side covers are pivotally mounted with respect to the dead-front member 20.

Figure 2:
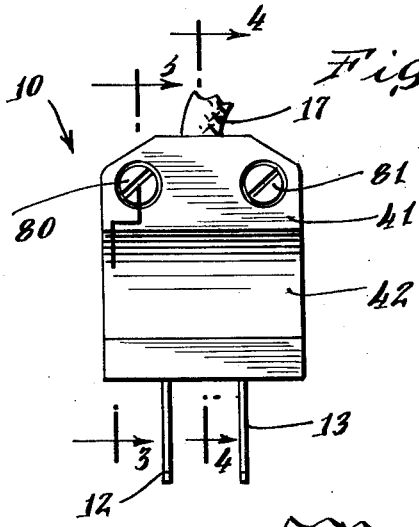
FIG. 2 is a front view of the electrical plug connector of FIG. 1.

The side cover 40 comprises a front panel 41, which, as viewed in FIG. 2, comprises the front of the dead-front electrical plug 10. A concave portion 42 of the front panel 41 cooperates with a similar concave portion 62 on panel 61 of side cover 60, which comprises the back of the electrical dead-front plug 10, as viewed in FIG. 2, to facilitate gripping the assembled plug for inserting it into and removing it from electrical socket outlets.

The side cover 40 further comprises a wall 43 which is generally perpendicular to and extends around three sides of the front panel 41. The wall 43 forms substantially one-half of the ends and top of the assembled dead-front electrical plug 10, as best seen in FIG. 1. In the portion of wall 43 which forms the top of the assembled dead-front electrical plug 10 there is defined a semi-circular opening 44 which accommodates the passage of cord 17.

The wall 43 further includes a shoulder 45 which extends about the inner periphery thereof except at the semi-circular opening 44. The shoulder 45 is partially defined by two blocks 46 and 47 which are also integral with the front panel 41. Two cord clamp teeth 50 and 51 upstand from the inner surface of front panel 41 and are integral with and diagonally disposed between the two blocks 46 and 47. The upper surfaces of the cord clamp teeth 50 and 51 are concave.

Figure 3:
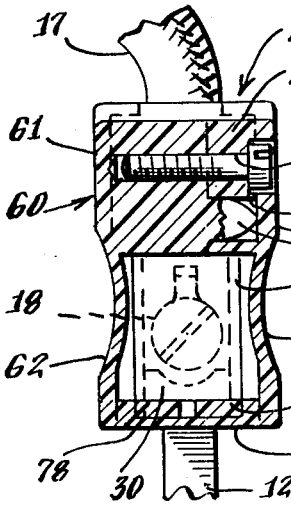
FIG. 3 is a sectional view of the electrical plug connector of FIG. 1 taken along the lines 3—3 of FIG. 2.

Two oblong openings 52 and 53 are formed through the blocks 46 and 47, respectively, and front panel 41 integral therewith, flanking the cord clamp teeth 50 and 51. The openings 52 and 53 are preferably countersunk adjacent to the front panel 41, as best seen in FIG. 3. Two additional rectangular openings 54 and 55 are formed partially through blocks 46 and 47, respectively, from the shoulder 45 of side wall 43.

The side cover 40 further comprises a rectangular flange 56 upstanding from the inner surface of front panel 41 between the two webs comprising the web hinge 15, and flange 56 is matingly received in the notch 22 formed in the dead-front member 20 when the dead-front electrical plug 10 is in its fully assembled condition, as best seen in FIG. 4. Two additional flanges 57 and 58 extend from the ends of wall 43, and are received in the grooves 27 and 28 of the dead-front member 20 when the dead-front electrical plug 10 is in its assembled condition, as best seen in FIG. 3.

As noted above, the side cover 60 is comprised of a back panel 61 having a concave portion 62. The side cover 60 is integrally hingedly connected to the dead-front member 20 by means of web hinge 16. A wall 63 upstands generally perpendicularly to the back panel 61 and extends around three sides thereof, and the wall 63 is shaped to cooperate with wall 43 of side cover 40 to form the ends and top of the assembled dead-front electrical plug 10. A semi-circular opening 64 is defined by the wall 63 opposite the opening 44 in wall 43 such that the two openings 44 and 64 together accommodate passage of the cord 17. Integral with the wall 63 along the inside edge thereof are two flanges 65 and 66 and two blocks 67 and 68. A shoulder 69 is formed along the outside of wall 63 adjacent to the flanges 65 and 66 and the blocks 67 and 68.

Two cord clamp teeth 70 and 71 upstand from the back panel 61 and are integral with and extend diagonally between the blocks 67 and 68. The upper surfaces of the cord clamp teeth 70 and 71 are concave, and it will be noted that the diagonal orientation of the cord clamp teeth 70 and 71 is opposite to that of cord clamp teeth 50 and 51 of side cover 40 such that the two sets of cord clamp teeth crisscross when the dead-front electrical plug 10 is in its assembled condition.

Two openings 72 and 73 are formed partially through the blocks 67 and 68, respectively, flanking the cord clamp teeth 70 and 71. Protruding upwardly from the flanges 65 and 66, respectively, are two prongs 74 and 75. Side cover 60 further comprises a flange 76 upstanding from the interior surface of the back panel 71 between the webs of web hinge 16 and juxtaposed the notch 23 in the dead-front member 20, and flange 76 is matingly received in notch 23 when the electrical dead-front plug 10 is in its assembled condition. Two additional flanges 77 and 78 are provided at the terminal ends of wall 63 and are received in grooves 26 and 27, respectively, as best seen in FIG. 3.

The dead-front electrical plug 10 is assembled by first stripping and connecting the ends of the two wire conductors 32 and 33 of cord 17 to the upper ends of the power blades 12 and 13 via terminal screws 18 and 19. The sealing compound barrier sleeve 35 and sealing compound, if desired, are then placed over the wire connections. After wiring has been completed, the side covers 40 and 60 are pivoted together so that the electrical dead-front plug 10 is in the assembled condition illustrated in FIGS. 1 - 4. The flanges 65 and 66 of side cover 60 butt against the shoulder 45 of side cover 40 and lie inside the wall 43 thereof. Similarly, the upper portion of wall 43 fits tightly against shoulder 69. This overlapping engagement between side covers 40 and 60 provides for a dust free interior of the dead-front electrical plug 10 and makes it resistant to the insertion of foreign objects.

Top surfaces of blocks 46 and 47 butt against the top surfaces of blocks 67 and 68. The prongs 74 and 75 of side cover 60 are received in the openings 54 and 55 of side cover 40, and the interengagement therebetween keeps the side covers 40 and 60 in alignment as the cord clamp teeth 50, 51, 70 and 71 grip the cord 17, as best seen in FIG. 4, and thereby relieve any strain on the wiring connections. The through openings 52 and 53 formed in side cover 40 align with the partial openings 72 and 73 in blocks 67 and 68 formed in side cover 60, and two self-threading screws 80 and 81 are threaded into the openings to secure the side covers 40 and 60 together.

As noted above, the flanges 56 and 76 are respectively matingly received in the notches 22 and 23 of the dead-front member 20, and the resultant interengagement provides longitudinal strength between the side covers 40 and 60 and the dead-front member 20 of the plug 10. Thus, the cooperation of flanges 56 and 76 and notches 22 and 23 relieves any longitudinal stress which would otherwise be placed on the web hinges 15 and 16 when the side covers are gripped to remove the dead-front electrical plug from an electrical socket outlet. Similarly, the flanges 57 and 77 are received in the groove 28 in the dead-front member 20 and the flanges 58 and 78 are received in the groove 25 of the dead-front member 20 (as best seen in FIG. 3) to relieve any lateral stress extant between the side covers 40 and 60 and the dead-front member 20.

During assembly of the dead-front electrical plug 10, it may be desirable to add a rubber grommet (not shown) around the cord 17 between the semi-circular openings 44 and 64, and such grommet may be used alone or in addition to the sealing compound barrier sleeve 35 and sealing compound.

Thus, the dead-front electrical plug 10 achieves the safety advantages of dead-front type electrical plugs and yet is extremely easy to wire, is extremely strong in its assembled condition, and is dust-proof and moisture-proof.

Referring now to FIGS. 7 - 10, there is shown a second embodiment 100 of a dead-front electrical plug according to the invention herein. It generally comprises a plug body 101, shown alone in FIG. 7, two power blades 102 and 103, and a ground pin 104. The dead-front electrical plug 100 is adapted to make electrical connection between a cord 113 comprising three wire conductors 114 - 116 and a grounded electrical socket outlet, not shown. The plug body 101 of the dead-front electrical plug 100 is generally comprised of a dead-front member 120 and two side covers 140 and 160 which are hingedly connected thereto by web hinges 110 and 111. The entire plug body 101 is integrally formed of an insulating material, which may be nylon.

The dead-front member 120 of the plug body 101 comprises a base plate 121, the outer surface of which forms a smooth insulating face or front of the dead-front electrical plug 100. Two parallel grooves 122 and 123 are formed partially through the base plate 121 adjacent the end edges thereof. A thicker central portion 124 of the dead-front member 120 is formed integrally with the base plate 121 thereof and serves as a supporting and mounting block for the power blades 102 and 103 and the ground pin 104. To this end two rectangular openings 125 and 126 and a U-shaped opening 127 are formed through the central portion 124 and integral base plate 121 to receive the power blades 102 and 103 and the ground pin 104, respectively. Each of the openings 125 - 127 is preferably provided with a sealing lip, e.g. sealing lip 128 of opening 125, which extends laterally into the opening adjacent the bottom surface of the base plate 121.

Figure 8:
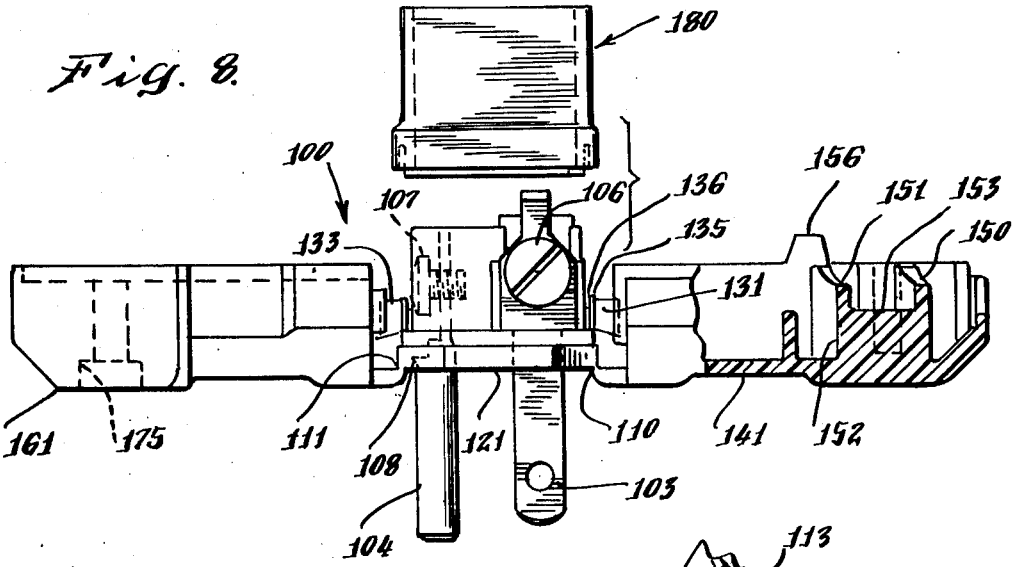
FIG. 8 is an end view of the electrical plug connector of FIG. 7 in its open position.

The power blades 102 and 103 and the ground pin 104 are pushed through the openings 125 - 127 and are retained therein by integral barbs, such as barb 108 of ground pin 104, best seen in FIG. 8. The upper ends of the power blades 102 and 103 and the ground pin 104 are provided with terminal screws 105 - 107, respectively, for making wiring connections with the three wire conductors 114 - 116 of cord 113. An insulation barrier 129 is integral with and upstanding from the central portion 124 of the dead-front member 120 and serves to isolate the power blades 102 and 103, the ground pin 104, and their associated terminal screws and any adjacent uninsulated portion of the wire conductors from each other.

Two dowel pins 130 and 131 protrude laterally from one side of the dead-front member 120. More particularly, the dowel pins 130 and 131 are positioned between the power blades 102 and 103, and are integral with the top of the thick central portion 124 and the insulation barrier 129 of the dead-front member 120. Two additional dowel pins 132 and 133 protrude laterally from the opposite side edge of the dead-front member 120, and dowel pins 132 and 133 are also integral with the thick central portion 124 and the insulation barrier 129. The dowel pins 132 and 133 flank the upper end of the ground pin 104 and its associated terminal screw 107. The dead-front member 120 further comprises a circumferential flange 135 and an associated groove 136 formed between it and the thick central portion 124. The flange 135 and groove 136 extend about the periphery of the thick central portion 124, and are elevated to pass over the dowel pins 130 - 133.

The side cover 140 comprises a panel 141, which forms the back of the assembled dead-front electric plug 100 as viewed in FIG. 4. Web hinge 110 comprises a thin web of the plug material which is integral with both the back panel 141 and the dead-front member 120, and thereby hingedly connects it with the side cover 140.

A U-shaped wall 143 upstands generally perpendicularly from the periphery of back panel 141 around three sides thereof to form substantially one-half of the top and ends of the assembled dead-front electrical plug 100. The wall 143 defines a semi-circular opening 144 which accommodates the passage of cord 113 and a surrounding sealing grommet 109. The upper edge of the wall 143 includes a flange 145 along the inside thereof, and a shoulder 146 is defined adjacent to the flange 145 along the outside of wall 143. The flange 145 is contiguous with two additional flanges 147 and 148 which protrude laterally from the ends of wall 143 as viewed in FIGS. 7 and 8, in alignment with the grooves 122 and 123, respectively, of the dead-front member 120.

Two parallel cord clamp teeth 150 and 151 are diagonally disposed between the legs of U-shaped wall 143 adjacent to the semi-circular opening 144. The cord clamp teeth 150 and 151 are integral with a thickened portion 152 of the back panel 141, and strengthening ribs 153 may also be provided in connection with the cord clamp teeth. Two openings 154 and 155 are formed partially through the side cover 140 in thickened surrounding portions of the wall 143, flanking the cord clamp teeth 150 and 151. Two prongs 156 and 157 are formed extending upwardly from the opposite legs of the U-shaped wall 143.

Figure 9:
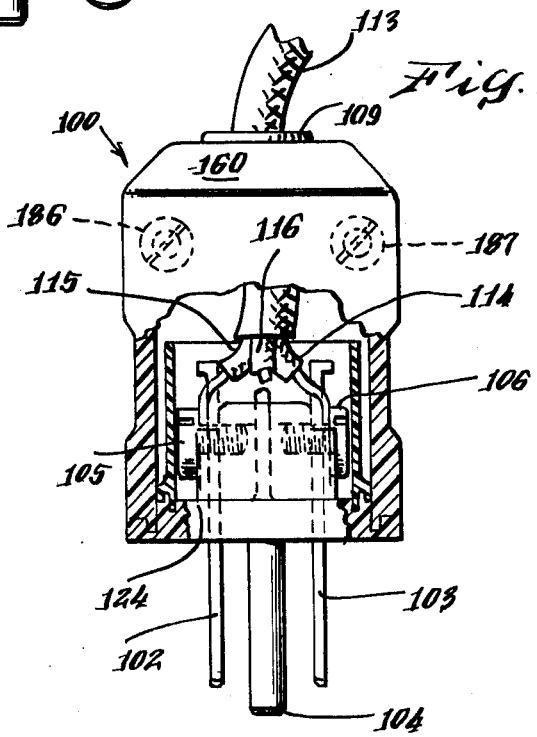
FIG. 9 is a front view, partially cut away, of the electrical plug connector of FIG. 7 in its closed position.

The back panel 141 of side cover 140 is provided with two openings 158 and 159 which matingly receive the dowel pins 130 and 131 when the dead-front electrical plug 100 is in its assembled condition shown in FIG. 9.

Side cover 160 is similar to side cover 140, and comprises a panel 161 which forms the front of the assembled dead-front electrical plug as viewed in FIG. 9. The side cover 160 is hingedly connected to the dead-front member 120 by means of web hinge 111. An upstanding U-shaped wall 163 extends around three sides of the back panel 160, and the wall 163 forms substantially the other half of the top and ends of the assembled dead-front electrical plug 100. The wall 163 defines a semi-circular opening 164 which cooperates with the opening 144 in wall 143 to accommodate passage of the cord 113 and its associated grommet 109. The upper edge of wall 163 terminates in a flange 165 and a shoulder 166, the flange 165 being disposed on the outside of the wall 143 and the shoulder 166 being located on the inside immediately adjacent thereto. Two additional flanges 167 and 168 protrude laterally from the ends of the U-shaped wall 163 as viewed in FIGS. 7 and 8, and are in alignment with the grooves 122 and 123, respectively, of the dead-front member 120.

Two parallel cord clamp teeth 170 and 171 are diagonally disposed between two blocks 172 and 173, the blocks 172 and 173 being integral with both the wall 163 and front panel 161 of side cover 160. The cord clamp teeth 170 and 171 are oppositely diagonally disposed to the cord clamp teeth 150 and 151 of side cover 140 such that the two sets of cord clamp teeth crisscross when dead-front electrical plug 100 is assembled. Two openings 174 and 175 are formed in the blocks 172 and 173 respectively, and the openings 174 and 175 are countersunk into the outside surface of front panel 161, as best seen in FIG. 8. Two additional openings 176 and 177 are formed in the blocks 172 and 173, respectively, adjacent to the legs of the U-shaped wall 163. The front panel 161 defines an additional two openings 178 and 179 which receive the dowel pins 132 and 133 when the electrical dead-front plug 100 is assembled.

The dead-front electrical plug 100 is assembled by first connecting the wire conductors 114 - 116 of cord 113 to the power blades 102 and 103 and the ground pin 104 via the terminal screws 105 - 107. The wiring connections are easily made with the dead-front electrical plug 100 in the open condition shown in FIG. 8.

Figure 10:
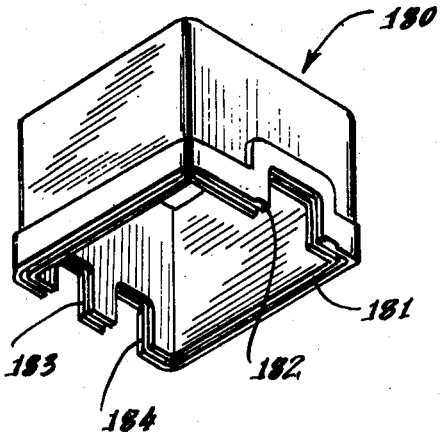
FIG. 10 is a perspective view of a sealing compound barrier for the electrical plug connector of FIG. 7.

An optional, generally rectangular sealing compound barrier sleeve 180, shown in FIG. 10, is fitted over and surronds the upper ends of the power blades, ground pin, and the wiring connections thereto. The sealing compound barrier sleeve has a groove 181 formed in its lower edge, and the groove 181 receives the circumferential flange 135 of the dead-front member 120. The inside edge of the sealing compound barrier sleeve 180 is received in groove 136 adjacent to flange 135. The lower edge of the sealing compound barrier sleeve 180 is notched at 182, 183 and 184, and notch 182 fits over the more closely spaced dowel pins 130 and 131. The notches 183 and 184 fit over the other more widely spaced dowel pins 132 and 133. A sealing compound (not shown) is placed in the sealing compound barrier sleeve 180, and in this regard it should be noted that the sealing lips such as sealing lip 128 in the opening 125 for power blade 102, prevent any sealing compound from leaking through the dead-front member 120 around the power blades or ground pin.

The side covers 140 and 160 are pivoted together about the web hinges 110 and 111. It will be noted that the side covers 140 and 160 are similarly shaped and fit together to form a smooth exterior of the dead-front electrical plug 100. In particular, the flange 145 and shoulder 146 of side cover 140 interlock with the flange 165 and shoulder 166 of side cover 160 to provide a relatively dust-proof joint which also protects against the insertion of foreign objects into the wiring area.

The prongs 156 and 157 of side cover 140 are received in the openings 176 and 177, respectively, of side cover 160, and the prongs thereby maintain the side covers in alignment against misaligning forces created as the cord 113 is clamped between the crisscrossed cord clamp teeth 150, 151, 170 and 171. The dowel pins 130 - 133 fit snugly into the openings 158, 159, 178 and 179 in the side covers. This interengagement between the dowel pins and the side covers bears any longitudinal forces exerted between the side covers and dead-front member 120, such as those created in pulling the dead-front electrical plug 100 from an electrical socket outlet, and relieve what would otherwise be a stress on the web hinges 110 - 111. The flanges 148 and 168 fit into the groove 123 in the dead-front member 120, and the flanges 147 and 167 fit into the other groove 122 formed in the dead-front member 120. The interengagement between flanges 147, 148, 167 and 168 and grooves 122 and 123 bears any lateral forces created between the side covers and the dead-front member 120, thus completing full stress protection of the web hinges 110 and 111. The covers are secured together by self-tapping screws 186 and 187 which are inserted through the openings 174 and 175 in side cover 160 and are threaded into the openings 154 and 155 in side cover 140.

Thus, the dead-front electrical plug bodies described above are comprised of a single molded piece to which only power blades need be added, which achieves low construction costs. There are no separable parts which can be lost during wiring, and the open condition of the dead-front electrical plugs allows complete access to the terminal screws and greatly facilitates the making of wiring connections. Only two assembly screws are required, and thus the dead-front electrical plugs are easily assembled without the exercise of any particular skill.

The interlocking members of the dead-front electrical plugs relieve any possible stress on the web hinges, and provide an extremely strong structure which is fully insulated. With the addition of the optional sealing compounds barriers and the sealing compound, the dead-front electrical plugs are made fully moisture-proof.

It will be appreciated that certain changes may be made in the electrical dead-front plugs described above without departing from the spirit and scope of this invention, which is limited only by the following claims.

What I claim is:

1. A housing for electrical terminals to which conductors of an electrical cord may be electrically wired, the housing having a longitudinal axis and comprising:

a base member constituting the front of the housing and being disposed transverse to the longitudinal axis, said base member being composed of an electrical insulating material and containing apertures for passage of conductive contact members, at least two longitudinally disposed side casings composed of an electrical insulating material and having respective first and second ends, web hinge means joining the first end of each of said side casings to said base member to form a unitary structure and to permit pivoting of said casings, about respective axes transverse to said longitudinal axis, from an open position to a closed position which is generally longitudinal, means adjacent the second ends of said casings for maintaining said casings in a closed position and clamping the electrical cord to the housing, terminal mounting means fixed to said base member and located within the casings when they are in a closed position, and locking means adjacent the first end of each of the side casings, exclusive of the web hinge means, for locking the side casings to said base member against relative displacement both transverse to and parallel to said longitudinal axis when the casings are closed.

2. The housing acording to claim 1 wherein each of the casings is shell-like in configuration and adjacent casings have coaligned free edge portions that meet when the casings are in a closed position whereby the interior walls of the closed casings form within them a housing chamber which is substantially enclosed by the casings, said terminal mounting means being located within the chamber, said shell-like casings including end cover portions at the ends of the casings remote from the web hinges, said end cover portions extending toward one another and cooperating to grip the electrical cord therebetween.

3. The housing in claim 2 wherein each of said end cover portions includes a threaded member and each such threaded member is substantially coaligned with the threaded member of each other end portion to surround and form gripping contact with said electrical cord.

4. The housing according to claim 1 further including interengaging members on each of said side casings for engaging one another as said casings are closed to inhibit misalignment of said casings when they clamp onto the electrical cord.

5. A one-piece electrical housing of the dead-front type for housing electrical terminals and permitting electrical contact thereto through apertures in the dead-front, the housing having a longitudinal axis and comprising:

a base member constituting the dead-front of the housing and being disposed transverse to the longitudinal axis, electrical terminals mounted on said base member, said base member composed of electrical insulating material and having apertures therethrough for electrical connection from said terminals to external electrical circuitry, at least two side casings composed of electrical insulating material and having respective first and second ends, web hinge means joining the first end of each of said side casings to said base member to form a unitary structure and to permit pivoting movement of said casings from a closed position which is generally longitudinal and encloses said terminals to an open position which renders the terminals accessible for wiring, and a plurality of interlocking members, at least one of which is located on each of said side members adjacent the first end thereof, and at least a corresponding number of which are located on the base member, one on the base member being in cooperating relationship with each one on the side casings, said interlocking members removing both transverse and longitudinal stress from the web hinges when the side casings are closed and locking the side casings to said base member against relative displacements both transverse to and parallel to said longitudinal axis.

6. The housing according to claim 5 wherein, when a side casing is closed, at least one interlocking member on the side casing engages its cooperating interlocking member on the base member at a location which is inwardly of the web hinge for the casing, to provide a lock against laterally outward displacement of the casing at its first end.

7. The housing according to claim 6 wherein said interlocking members engage one another, to provide the locking action against laterally outward displacement of the casing, in substantially the plane of the web hinges.

8. The housing according to claim 7 wherein said interlocking members are integral with all of the parts of the housing and formed of the same material.

9. A housing with electrical terminals to which a conductor of an electrical cord may be electrically wired, the housing having a longitudinal axis and comprising:

a base member disposed transverse to the longitudinal axis, electrical terminals mounted on said base member and disposed within said housing, said base member being composed of insulating material and containing apertures for electrical connection between said terminals and external electrical circuits, at least two side casings composed of electrical insulating material for enclosing said terminals, each of said side casings having first and second ends, web hinge means joining the first end of each of said side casings to said base member to form a unitary structure and to permit pivoting of said side casings, about respective axes transverse to said longitudinal axis, from a closed generally longitudinal position enclosing said terminals to an open transverse position providing access to the terminals, locking means adjacent the first end of each of the side casings, exclusive of the web hinge means, for locking the side casings to said base member against relative displacement transverse to said longitudinal axis when the casings are closed, said locking means including interengaging locking members, one on the base member and one on a side casing, for each of the side casings, said interengaging locking members engaging one another when the respective side casing is closed, at a location inwardly of the web hinge associated with the side casing, and in substantially the same transverse plane as the web hinge, to inhibit transverse displacement of the side casing from the base member.

10. The housing according to claim 9 further including second interengaging locking members, one on the base member and one on a side casing, for each of the side casings, said second interengaging locking elements engaging one another when the respective side casing is closed, to remove longitudinally directed stress from the associated web hinge and inhibit longitudinal displacement of the side casing from the base member.

11. The housing according to claim 9 further including interengaging members on each of said side casings for engaging one another as said side casings are closed to inhibit misalignment of said side casings.

12. A housing for an electrical terminal to which an electrical cord may be wired, the housing having a longitudinal axis and comprising:

a base member constituting the front of the housing and being disposed transverse to the longitudinal axis, said base member being composed of an electrical insulating material and containing one or more apertures each for passage of a conductive contact member, at least two side casings integral with said base member and also composed of an electrical insulating material, each of said side casings having first and second ends, web hinge means joining the first end of at least one of said side casings to said base member to permit pivoting movement of said one casing about an axis transverse to said longitudinal axis, from a closed generally longitudinal position to an open transverse position, terminal mounting means fixed to said base member and within said housing, and locking means having at least a portion thereof adjacent the first end of said one side casing, exclusive of the web hinge means, for locking said one side casing to said base member at a locaion near the web hinge but inwardly thereof, said locking means inhibiting relative displacement both transverse to and parallel to said longitudinal axis when said one casing is closed.

13. A housing of the dead-front type enclosing electrical terminals to which conductors of an electrical cord may be electrically wired, the housing having a longitudinal axis and comprising:

a base member constituting the dead front of the housing and being disposed transverse to the longitudinal axis, electrical terminals mounted on said base member and disposed within said housing, said base member being composed of insulating material and containing apertures for passage of conductive contact members, at least two side casings integral with said base member and composed of the same electrical insulating material for enclosing said terminals, each of said side casings having first and second ends, web hinge means joining the first end of at least one of said side casings to said base member to permit pivoting movement of said one side casing about an axis transverse to said longitudinal axis, from a closed generally longitudinal position enclosing said terminals and to an open position providing access thereto, locking means adjacent the first end of said one side casing, exclusive of the web hinge means, for locking said one side casing to said base member when it is in a closed position, said locking means including first interengaging locking members, one on the base member and one on said one side casing, said first interengaging locking members engaging one another when said one side casing is closed, at a location inwardly of the web hinge means associated with said one side casing, and in substantially the same transverse plane as the web hinge means, to inhibit transverse displacement of the side casing from the base member, and said locking means also including second interengaging locking members, one on the base member and one on said one side casing, said second interengaging locking members engaging one another when the said one side casing is closed, to remove longitudinally directed stress from the web hinge to inhibit longitudinal displacement of said one side casing from the base member.

14. The housing according to claim 13 wherein the web hinge means provides a pivot connection between each of the side casings and the base member, and where first and second interengaging locking members are present for each such side casing and the base.

* * * * *

UNITED STATES PATENT AND TRADEMARK OFFICE

CERTIFICATE OF CORRECTION

PATENT NO. : 4,067,634

DATED : January 10, 1978

INVENTOR(S) : Ernest Gerhard Hoffman

It is certified that error appears in the above-identified patent and that said Letters Patent are hereby corrected as shown below:

| | |
|---|---|
| Claim 12, lines 21 and 22, | change "fixed to said base member and within" to - - mounted on - - . |
| Claim 14, line 6, | insert the term "member" after - - base - - and before the period (.). |

Signed and Sealed this

*Twenty-fourth* Day of *October 1978*

[SEAL]

*Attest:*

RUTH C. MASON
*Attesting Officer*

DONALD W. BANNER
*Commissioner of Patents and Trademarks*